United States Patent [19]

Goebel et al.

[11] 3,940,054

[45] Feb. 24, 1976

[54] TISSUE CARTON

[75] Inventors: Henry R. Goebel; Joseph Flynn, both of Camarillo, Calif.

[73] Assignee: Western Kraft Corporation, Camarillo, Calif.

[22] Filed: Nov. 15, 1974

[21] Appl. No.: 523,969

[52] U.S. Cl. ..... 229/51 D; 221/63; 229/7 R

[51] Int. Cl.[2] ..... B65D 17/16

[58] Field of Search ..... 229/51 D, 51 AS, 7 R; 221/33, 34, 35, 44–55, 61–63

[56] References Cited

UNITED STATES PATENTS

| | | | |
|---|---|---|---|
| 2,019,538 | 11/1935 | Komdolf | 229/30 X |
| 2,583,211 | 1/1952 | Fleming | 229/51 D X |
| 2,991,000 | 7/1961 | Spees | 229/51 AS |
| 3,168,976 | 2/1965 | Metzger | 229/51 D |
| 3,239,097 | 3/1966 | Bates et al. | 221/48 |
| 3,254,793 | 6/1966 | Palmer | 221/63 |
| 3,258,156 | 6/1966 | Smith | 221/63 |

*Primary Examiner*—Davis T. Moorhead
*Attorney, Agent, or Firm*—Eugene D. Farley

[57] ABSTRACT

A tissue carton has in its top panel an opening dimensioned to pass tissues contained in the carton and covered with a removable strip of transparent film material permitting inspection of the carton contents.

4 Claims, 5 Drawing Figures

TISSUE CARTON

BACKGROUND OF THE INVENTION

This invention relates to cartons for retaining and dispensing tissues.

Cartons containing and dispensing facial tissues and other types of tissue products commonly are characterized by the presence of a top panel having a central elongated opening dimensioned to pass the tissues. In the marketed condition of the carton this opening is closed by means of an integral panel segment connected to the rest of the panel by a continuous perforation of characteristic outline. To convert the carton to its use condition, this segment is torn out along the perforation. The tissues then may be withdrawn one at a time through the resulting opening.

Although widely used, tissue cartons of this class have the common disadvantage of not permitting inspection of the contents.

It accordingly is the general object of the present invention to provide a tissue carton having a dispensing opening which in the distribution and sales condition of the carton is closed by a transparent strip which permits inspection of the carton contents.

It is a further object of the present invention to provide a tissue carton having in its top panel a transparent strip which protects the carton contents from dust and dirt and at the same time renders the contents clearly visible for inspection by prospective purchasers.

Still a further object of the present invention is to provide a tissue carton having in its top panel a central tissue dispensing opening sealed by means of a transparent strip which may be removed cleanly and easily to permit withdrawal of the tissues through the opening, one at a time.

GENERAL STATEMENT OF THE INVENTION

The foregoing and other objects of the present invention are accomplished by the provision of a tissue carton which, broadly considered, comprises a blank of foldable carton material including top, bottom, and side panels and a plurality of end flaps connected thereto and foldable into carton-forming relation. The top panel has an opening dimensioned to pass tissues contained in the carton. A piece of transparent film material is secured across the opening. A pull tab comprising a perforation-defined segment of the top panel is secured to the piece of transparent film material.

During distribution and sale of the goods, the transparent film material lies across the opening, protecting the tissue contents of the carton but permitting their ready inspection. In the use of the carton, the transparent film material is readily removed by gripping the pull tab secured thereto and stripping both pull tab and film material from the top panel of the carton.

THE DRAWINGS

In the drawings:

FIG. 1 is bottom plan view of a blank of carton-forming material cut to shape, scored, and ready for folding and assembly into the tissue carton of the invention.

FIGS. 2, 3, 4, and 5 are progressive, fragmentary, top perspective views illustrating the manner and use of the carton, in particular the manner of stripping from the top panel thereof the protective sheet of transparent film material which covers the dispensing opening preparatory to removing the tissue contents of the carton one tissue at a time.

DESCRIPTION OF A PREFERRED EMBODIMENT

Figure 1:
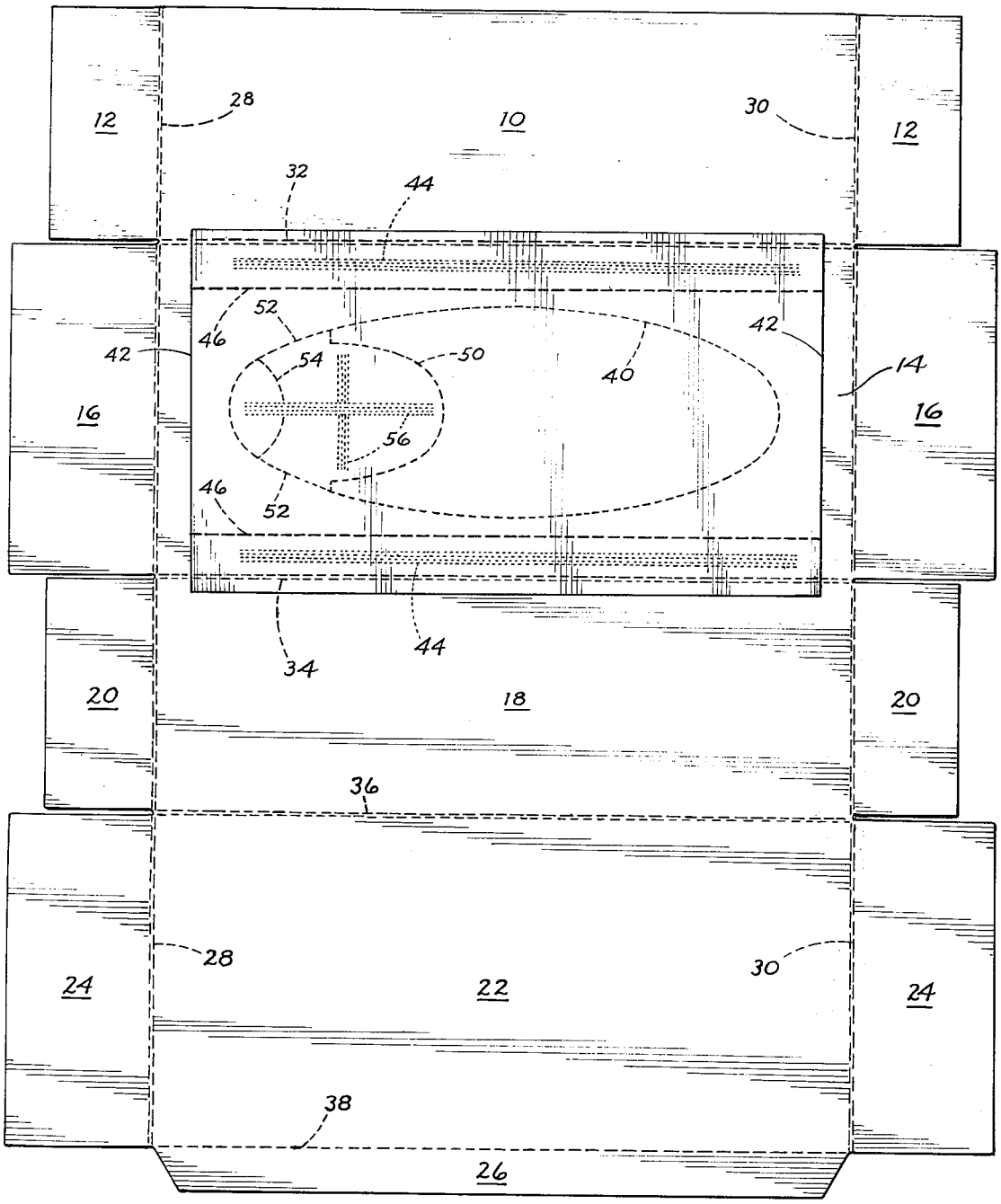

As illustrated in FIG. 1, the tissue carton of our invention is fabricated from a die cut blank of cardboard, heavy paper, or other carton-forming material. The blank is cut to predetermined size and contour and includes an end panel 10 with end flaps 12, a top panel 14 with end flaps 16, a second end panel 18 with integral end flaps 20, and a bottom panel 22 with end flaps 24, and a side glue flap 26.

The end flaps 12, 20 of end panels 10, 18 are inwardly offset from end flaps 16, 24 of top and bottom panels 14, 22. The end flaps of all the panels are defined by common score lines 28, 30 which extend in parallel straight lines along the respective side margins of the blank. The top, bottom and end flaps as well as the glue flap are defined by spaced, parallel score lines 32, 34, 36 and 38 which lie at right angles to score lines 28, 30 defining the end flaps.

There thus is provided a blank which may be folded along the score lines to place the various blank segments into carton-forming relation with each other. The segments then may be glued together in usual manner to form the finished carton.

Provision is made in top panel 14 for an opening temporarily closed with a piece of transparent film material which seals the carton against the entry of dust and dirt during distribution and sale, but which may be removed to reveal a tissue-dispensing opening during use. The construction of the top panel embodying this feature is also illustrated in detail in FIG. 1.

As illustrated in that figure, the top panel is provided with an elongated central opening 40, usually oval in contour. This opening is of sufficient size to pass the tissue contents of the carton one at a time.

Opening 40 is sealed against entry of dirt and dust by means of a piece 42 of transparent film material such as transparent plastic film. For convenience of manufacture, this piece may be rectangular in outline and roughly commensurate in size with top panel 14 which it underlies. It is secured to the underside of the top panel by suitable means, for example by means of glue stripes 44 applied along the longitudinal margins of the piece of film material.

For convenience of removal, the piece of transparent film material is provided with tear perforations 46 along its longitudinal margins, a spaced distance inwardly from its side edges. They thus lie between glue stripes 44 and the side margins of opening 40.

Pull tab means is associated with the piece of transparent film material 42 to assist in its removal when it is desired to open the carton.

The pull tab means comprises a tab-shaped segment 50 of top panel 14. This segment is generally oval in contour, extending inwardly of opening 40 and of sufficient extent to provide both a glue base and an adequate finger hold. It is attached to the top panel by a perforated tear line 52. Its inner end is defined by a concavely arcuate score line 54 to provide a terminal area which serves as a pressure-applying segment.

Pull tab 50 is secured to the top side of the piece 42 of transparent film material by suitable means, as for example by glue stripes 56 applied to the underside of the pull tab.

The piece of transparent film material with associated pull tab thus makes it possible to inspect the contents of the carton through opening 40 in the top panel during merchandising of the goods. When it is desired to use the contents of the carton, the sequence illustrated in FIGS. 2–5 inclusive is followed.

Figure 2:
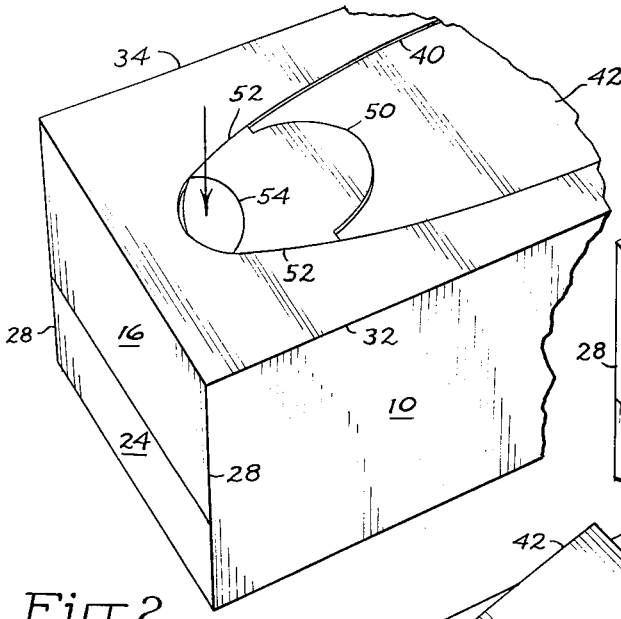
Figure 3:
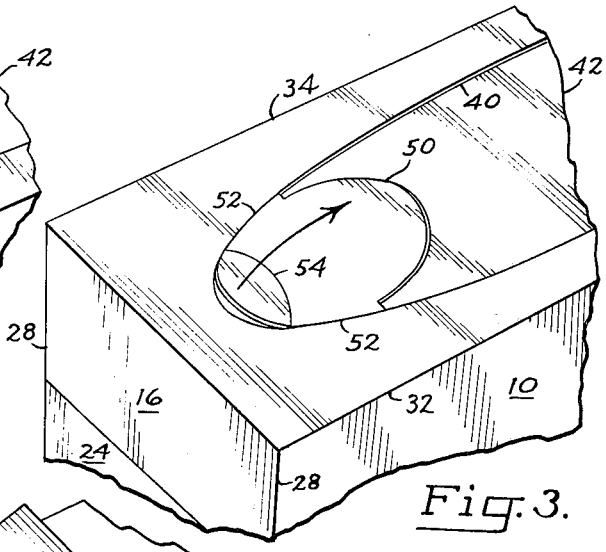

First, as shown in FIG. 2, the terminal pressure segment of pull tab 50 defined by score line 54 is depressed. This breaks tear line 52 along the arc immediately opposed to the score line and makes it possible to lift up the pressure segment as shown in FIG. 3.

Figure 4:
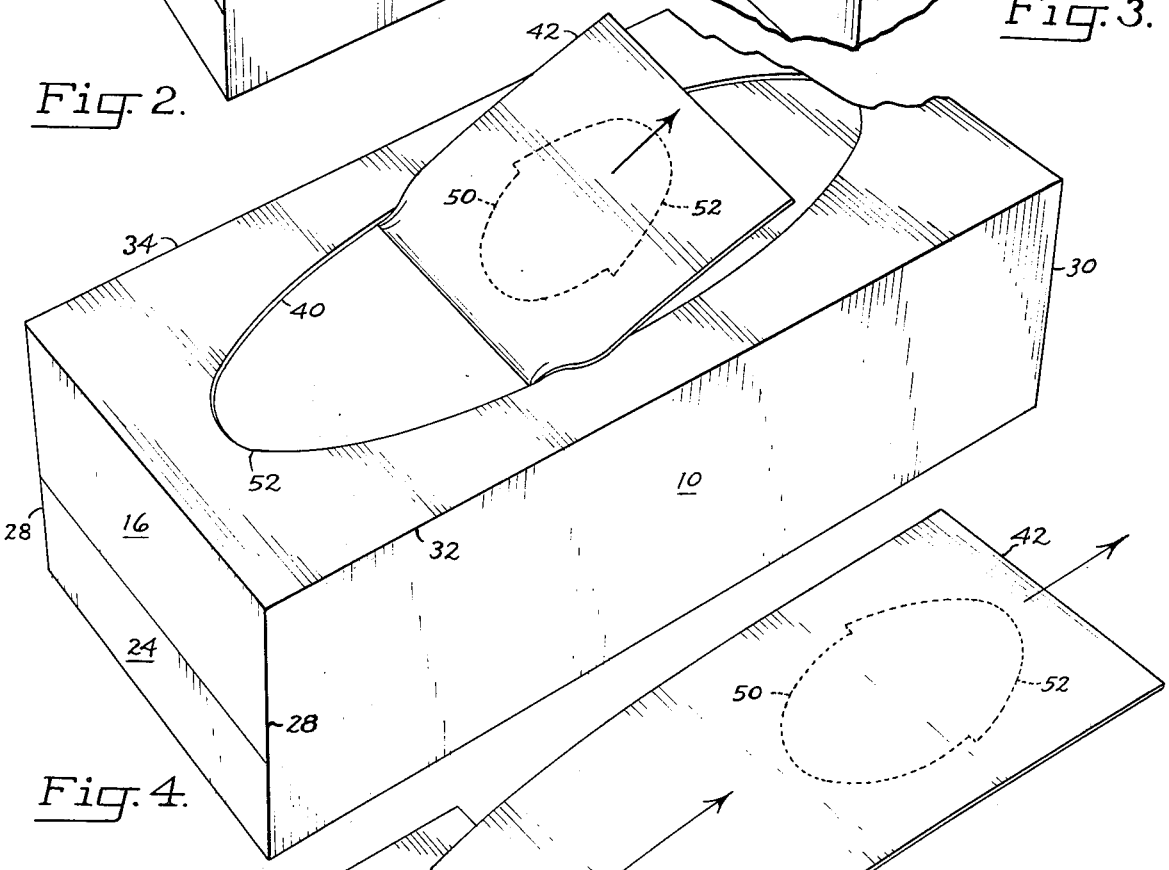
Figure 5:
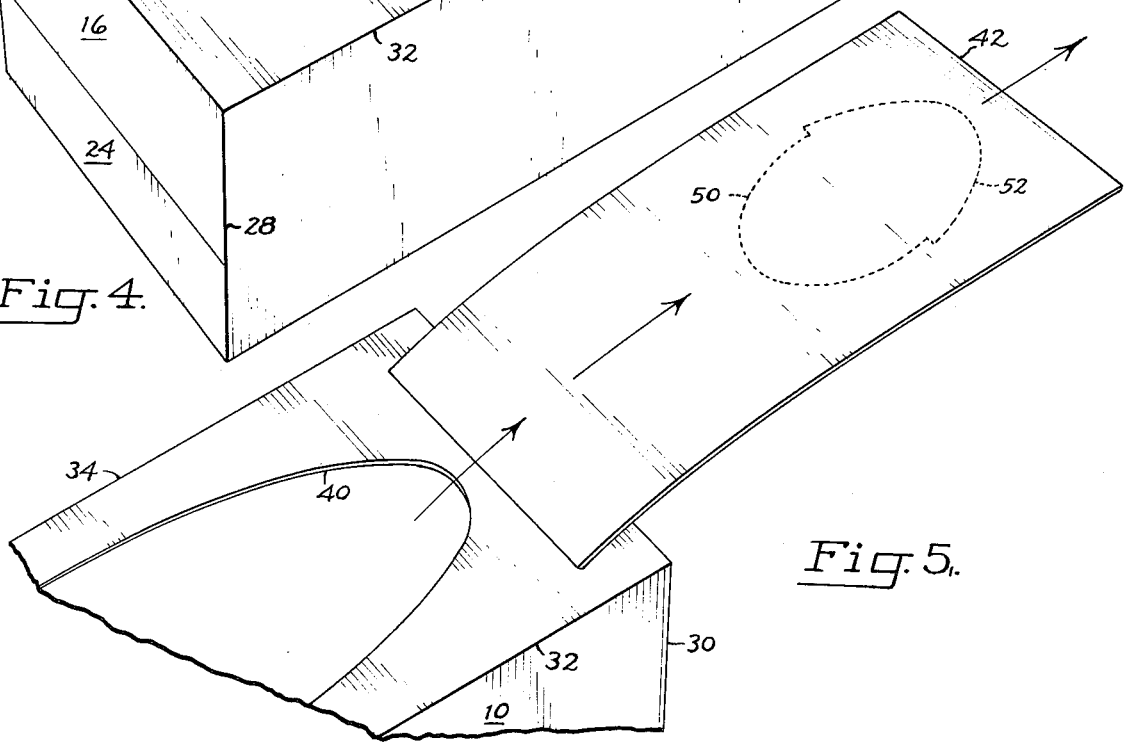

The end of the pull tab thus liberated than is grasped between the fingers and the pull tab pulled reversely as shown in FIG. 4. This not only separates the pull tab completely along score line 52, but also tears the protective sheet of transparent film material along longitudinal score lines 46. The pull tab and sheet material thus may be separated completely from the carton as shown in FIG. 5.

This exposes the uppermost tissue sheet, readily accessible for removal from the carton.

It is to be observed from the drawings that the tear line 52 registers with and forms a continuation of the peripheral margin of opening 40. Accordingly, when pull tab 50 has been detached from top panel 14 and removed with film piece 42, the full oval opening 40 is formed, exposing the tissues for removal.

Having thus described our invention in the preferred embodiments, we claim:

1. A tissue carton comprising:

a. a blank of foldable carton material including top, bottom, and side panels and a plurality of end flaps connected thereto and foldable into carton-forming relation, b. the top panel having an opening dimensioned to pass tissues contained in the carton, c. a piece of transparent film material extending across the opening and secured to the underside of the top panel outwardly of the peripheral margin of the opening, d. a pull tab for the piece of transparent film material comprising a perforation-defined segment of the top panel secured to the piece of transparent film material, the perforations defining said pull tab segment registering with and forming a continuation of the peripheral margin of the top panel opening.

2. The tissue carton of claim 1 wherein the pull tab is transversely scored to provide a finger hold segment.

3. The tissue carton of claim 1 wherein the opening is elongated and positioned centrally of the top panel and wherein the piece of transparent film material is longitudinally scored along its side margins between the peripheral margin of the opening and the area of the film material secured to the top panel.

4. A tissue carton comprising:

a. a blank of foldable carton material including top, bottom and side panels and a plurality of end flaps connected thereto and foldable into carton-forming relation, b. the top panel having a central elongated opening dimensioned to pass tissues contained in the carton.

c. a strip of transparent film material underlying the opening and glued to the underside of the top panel laterally of and parallel to the longitudinal margins of the opening, d. the strip being longitudinally perforated to form tear lines on both sides of the opening, inside the glue, and e. a pull tab comprising a perforation-defined segment of the top panel glued to the piece of transparent film material at one end thereof, the perforations defining said pull tab segment registering with and forming a continuation of the peripheral margin of the top panel opening, f. the pull tab having a transverse score defining a finger-hold segment thereof.

* * * * *